US006293030B1

(12) United States Patent
McCurtis et al.

(10) Patent No.: US 6,293,030 B1
(45) Date of Patent: Sep. 25, 2001

(54) HAIR DRYING APPARATUS

(76) Inventors: Martin L. McCurtis; LaToya Polk, both of 220 Edgewood Ter., Jackson, MS (US) 39206

( * ) Notice: Subject to any disclaimer, the term of this patent is extended or adjusted under 35 U.S.C. 154(b) by 0 days.

(21) Appl. No.: 09/756,608

(22) Filed: Jan. 8, 2001

(51) Int. Cl.[7] ..... A45D 17/08
(52) U.S. Cl. ..... 34/96; 34/97; 34/99
(58) Field of Search ..... 34/96, 97, 98, 34/99, 100; 392/380, 381, 382, 383, 384, 385

(56) References Cited

U.S. PATENT DOCUMENTS

| | | | | |
|---|---|---|---|---|
| 2,340,185 | * | 1/1944 | Gripp | 34/99 |
| 2,437,366 | * | 3/1948 | Thomas | 34/99 |
| 2,456,669 | * | 12/1948 | Bauer | 34/99 |
| 2,496,597 | * | 2/1950 | Newman | 34/99 |
| 2,725,642 | * | 12/1955 | Hudson | 34/99 |
| 2,738,592 | * | 3/1956 | Stanley | 34/99 |
| 2,738,593 | * | 3/1956 | Fox | 34/99 |
| 2,832,157 | * | 4/1958 | Hudson | 34/99 |
| 3,032,891 | * | 5/1962 | Parker | 34/99 |
| 3,068,587 | * | 12/1962 | Toellner | 34/99 |
| 3,108,862 | * | 10/1963 | Toulmin | 34/99 |
| 3,383,700 | * | 5/1968 | Taylor | 34/99 |
| 3,717,936 | | 2/1973 | Tolmie et al. . | |
| 3,818,600 | * | 6/1974 | Fischer | 34/99 |
| 3,822,483 | * | 7/1974 | Hubner | 34/99 |
| 3,829,984 | * | 8/1974 | Hubner | 34/99 |
| 3,831,000 | * | 8/1974 | Waters et al. | 392/383 |
| 3,972,126 | * | 8/1976 | DeMuro et al. | 34/100 |
| 4,112,591 | * | 9/1978 | Marsh | 34/99 |
| 4,121,353 | * | 10/1978 | Baumgartner et al. | 34/99 |
| 4,486,961 | * | 12/1984 | Giesselbach et al. | 34/100 |

* cited by examiner

*Primary Examiner*—Teresa Walberg
*Assistant Examiner*—Fadi H. Dahbour
(74) *Attorney, Agent, or Firm*—John D. Jeter

(57) ABSTRACT

The hood is fitted with a fan in the crown that directs air flow upward from the hood interior. The hood has a liner that provides an air distribution plenum between hood and liner. Air flows from the plenum toward hair being dried from holes in the plenum. Some of the holes are, preferably, fitted with movable jets which can be rotated to provide the out flow pattern preferred for the particular hair style being dried.

7 Claims, 2 Drawing Sheets

PRIOR ART

HAIR DRYING APPARATUS

This invention pertains hair drying apparatus of the hood type, supported for variable positioning on structure extending from a base usually supported by a table or floor.

BACKGROUND

Hooded hair dryers are normally found in beauty salons. They usually have heating arrangements to provide a stream of warmed air that is introduced to the hood for distribution over the head of an individual. The air is normally fan driven and leaves the hood in a downward direction which sweeps around the face of the individual. Chemicals used on the hair emit vapors that are entrained with the air stream that sweeps about the face. Warm air, particularly with chemical odors present, make breathing by the occupant uncomfortable.

SUMMARY OF INVENTION

The hood, supported by any suitable stand, has a fan driven source of hot air for ejection from the hood toward the hair of an occupant. In the apex of the hood a fan draws air from inside the hood and directs it upward, drawing air from around the head of the occupant. Upward air direction prevents hot air streaming about the occupants face. The hot air source is, preferably, enclosed in the supporting stand or base and is delivered to the hood by way of a duct. The hot air is preferably distributed within a plenum formed by the hood and a hood liner. Air is directed from the liner through a plurality of holes distributed about the liner. For adaptation to use with different hair styles, at least some of the holes have nozzles that can be rotated to cause a desired air flow pattern.

By preference, the nozzles near the lower edge of the hood can be rotated to direct air within or below the hood. Downwardly directed air is entrained by the upwardly moving general air flow, toward the fan, and causes little discomfort for the occupant.

These and other objects, advantages, and features of this invention will be apparent to those skilled in the art from a consideration of this specification, including the attached claims and appended drawings.

BRIEF DESCRIPTION OF DRAWINGS

In the drawings wherein like features have similar captions.

DETAILED DESCRIPTION OF DRAWINGS

Figure 1:
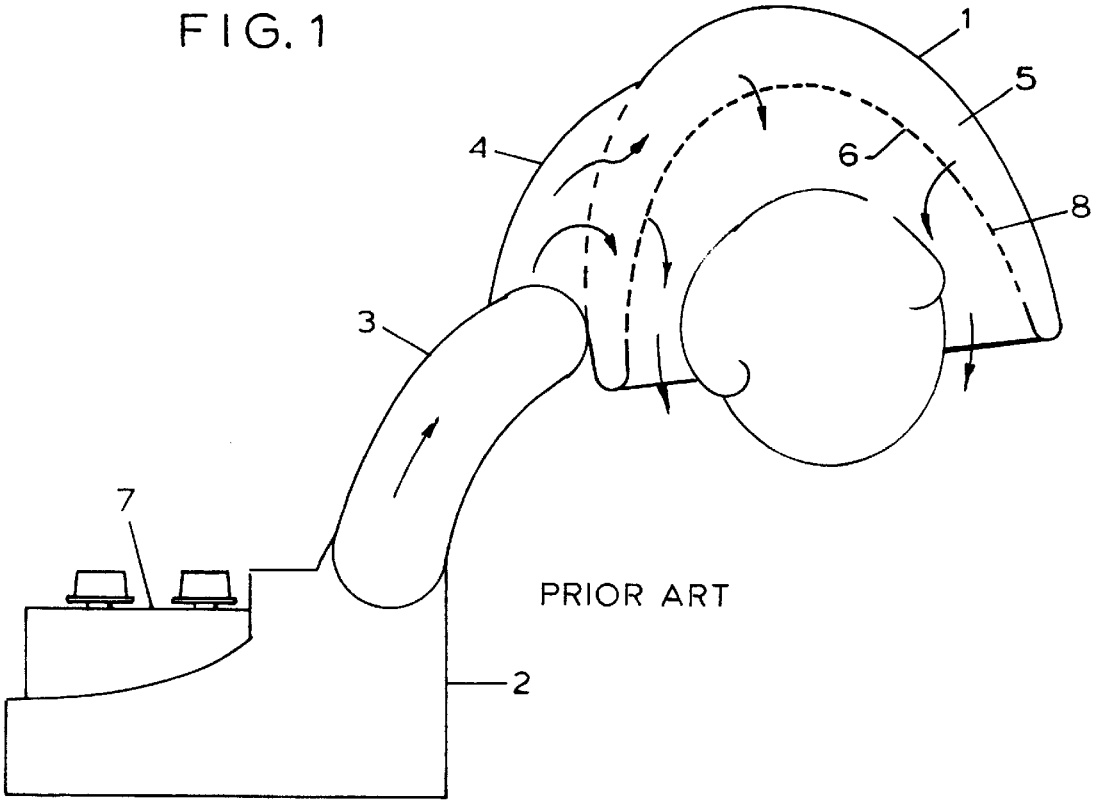
FIG. 1 is a side view, partly cut away of the most similar apparatus now in prior art.

In the drawings, some details of construction that are well established in the art, and having no bearing upon points of novelty, are omitted in the interest of clarity of descriptive matter. Such details may include weld lines, threaded fasteners, pins, and gaskets.

In FIG. 1, prior art is shown in a configuration most resembling the preferred embodiment of the present invention. Hood 1 is similar to the familiar hood of the typical salon fixture. Base 2 is commonly heavy and arranged for placement on a table. Hot air is normally prepared in the section 7 of the base and blown along the bore of extension 3, into diffuser 4, and distributed within the plenum 5 formed by the space between the hood 1 and the liner 8. From the plenum, air flows through holes, or nozzles, 6 in the liner, to impinge upon the occupants head. Hot moist air then courses downward around the occupant's face. That flow path causes occupant discomfort.

Figure 2:
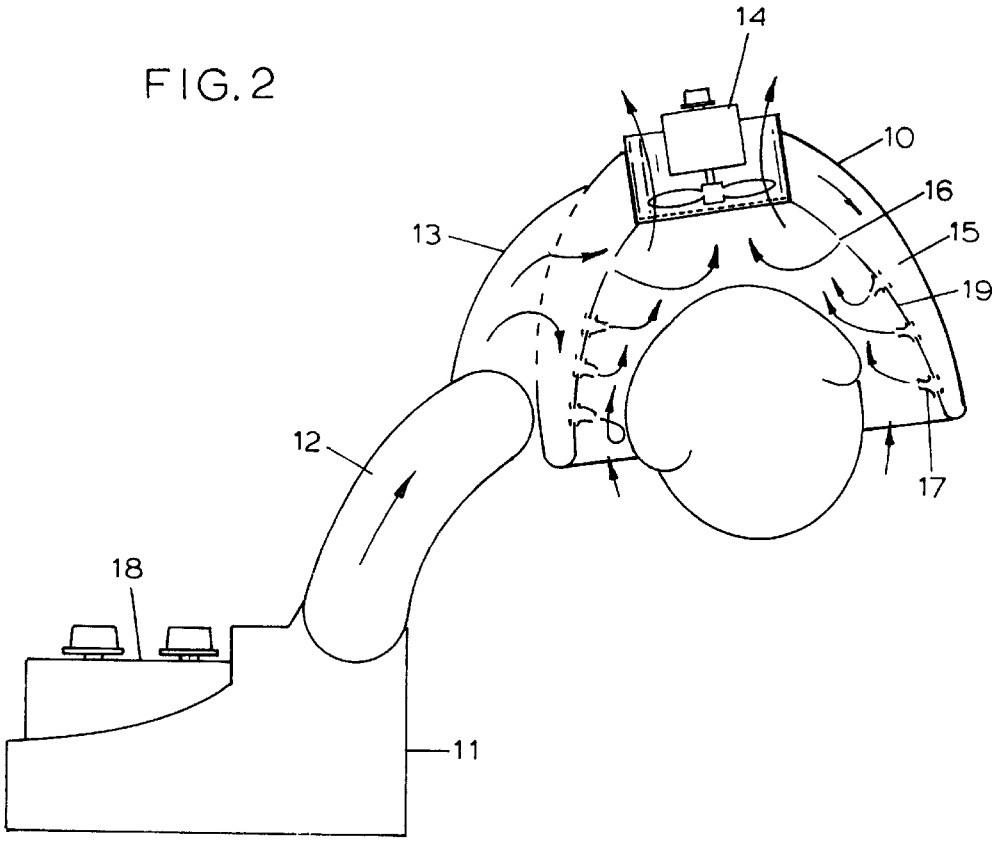
FIG. 2 is a side view, similar to that of FIG. 1, with the novel features of this invention in place.

In FIG. 2, the apparatus of FIG. 1 is essentially duplicated and a crown fan is added. The crown fan 14 draws air upward and expels it above the hood. The fan capacity can handle all air arriving from the base unit plus some additional capacity to lift air from around the face of the occupant. A fine mesh screen below the fan keeps hair from entering the fan.

Plenum 15 is formed of the space between hood 10 and liner 19. Nozzles 17 are installed in the liner for pivotal rotation in holes therein. That allows the user to custom form the general flow pattern to suit the purpose. Nearer the apex of the liner, simple holes 16 may be provided for air flow from the liner.

The base 11 is usually arranged to stand on table tops but could stand from the floor with minor configuration changes at the design level. Support link 12 is hollow and conducts air from the base to and through diffuser 13. Heater and fan unit 18 is adjustable for temperature and air flow rate control.

The arrows indicating air flow are shown somewhat chaotic, an indication of a measure of turbulence. Under control, that condition may be desirable to speed drying rate.

Figure 3:
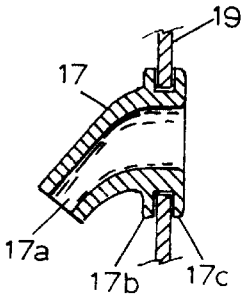
FIG. 3 is a side view, in cutaway, of part of the apparatus of FIG. 2.

In FIG. 3 the shaped nozzle 17 is free to swivel in the related bore in the liner 19. Flanges 17*b* and 17*c* may be flexible for ease of installation and to provide resistance to nozzle rotation to retain manually positioned settings of the nozzle. In places where the change in air flow direction is not large, a simple ball with a central bore may be resiliently retained in a socket in the liner. Flow direction is changed by inserting a rod in the bore and moving to pivot the ball to yield the preferred direction of air flow.

Figure 4:
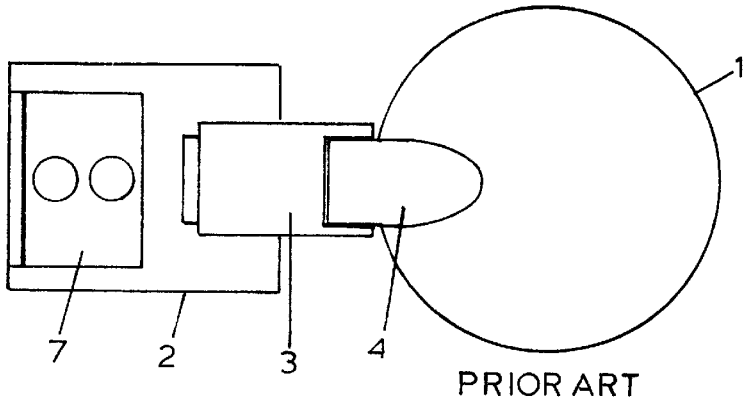
PRIOR ART FIG. 4
FIG. 4 is a top view, somewhat reduced in scale, of the apparatus of FIG. 1.
Figure 5:
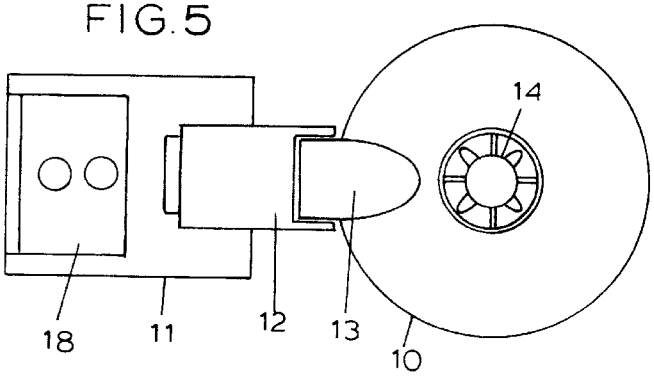
FIG. 5 is a top view, similar to that of FIG. 4, but having the preferred novel features in place.

In FIGS. 4 and 5 the captions relate to the associated side views 1 and 2 respectively.

From the foregoing, it will be seen that this invention is one well, adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

What is claimed is:

1. A hooded hair dryer apparatus with a hood and liner arranged to provide a plenum therebetween, with openings in the plenum to admit air flow toward an occupant below the hood, having a powered fan in the apex of the hood arranged to draw air upward between occupant and hood liner to facilitate drying and reduce the amount of hot humid air in the occupants face, the apparatus comprising:

a) a hood opening downwardly, with an apex defining the top;

b) a support to position the hood relative to the floor;

c) a liner having the general shape of the hood, with an apex at the top, with lower edges arranged for attachment to lower edges of the hood and to leave a space between hood and liner to provide an air plenum;

d) a hot air source to propel air into the plenum;

e) air flow ports in the liner to direct air toward the general center of the liner; and f) at least one motorized fan situated in the general apex of the hood, arranged to draw air from below the apex of the liner and discharge it above the hood.

2. The apparatus of claim 1 wherein movable jet nozzles are situated in at least some of said ports to permit selective focusing of air flow from said ports.

3. The apparatus of claim 1 wherein said hot air source is incorporated in said support.

4. A hooded hair dryer apparatus with a hood having an apex at the top and opening downward to accept a human head at least partly inserted therein, the apparatus comprising:

a) a support base arranged to rest on a plane surface and support said hood in a selected position;

b) a hot air source arranged to provide a stream of heated air to said hood;

c) air flow ducts inside said hood to receive air from said hot air source and distribute it to a plurality of openings inside said hood to project a plurality of air streams toward said human head;

d) a plurality of manually directable nozzles in at least some of said openings to permit selective air flow characteristic within said hood; and e) a motor driven fan situated in an opening at the apex of said hood and arranged to extract air from within said hood for expulsion above said hood.

5. The apparatus of claim 4 wherein said support base contains said hot air source.

6. The apparatus of claim 4 wherein said plane surface is a vertical wall and said support base contains said hot air source.

7. The apparatus of claim 4 wherein said air flow ducts comprise a plenum inside said hood, said plenum formed of space between said hood and a liner in the general shape of said hood, sealingly secured thereto at the lower edge, said openings inside said hood being in said liner.

* * * * *